US009771780B2

(12) United States Patent
Langlais

(10) Patent No.: US 9,771,780 B2
(45) Date of Patent: Sep. 26, 2017

(54) SYSTEM AND METHODOLOGY FOR FORMING GRAVEL PACKS

(71) Applicant: SCHLUMBERGER TECHNOLOGY CORPORATION, Sugar Land, TX (US)

(72) Inventor: Michael Langlais, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 428 days.

(21) Appl. No.: 14/168,260

(22) Filed: Jan. 30, 2014

(65) Prior Publication Data

US 2015/0198016 A1 Jul. 16, 2015

Related U.S. Application Data

(60) Provisional application No. 61/927,106, filed on Jan. 14, 2014.

(51) Int. Cl.

| | |
|---|---|
| ***E21B 43/04*** | (2006.01) |
| ***E21B 17/18*** | (2006.01) |
| ***E21B 17/04*** | (2006.01) |
| ***E21B 34/14*** | (2006.01) |

(52) U.S. Cl.

CPC ..... *E21B 43/04* (2013.01); *E21B 17/04* (2013.01); *E21B 17/18* (2013.01); *E21B 34/14* (2013.01)

(58) Field of Classification Search

USPC ..... 166/51

See application file for complete search history.

(56) References Cited

U.S. PATENT DOCUMENTS

| | | | | |
|---|---|---|---|---|
| 2004/0140089 | A1 | 7/2004 | Gunneroed | |
| 2005/0082060 | A1 | 4/2005 | Ward et al. | |
| 2008/0314589 | A1 | 12/2008 | Guignard et al. | |
| 2010/0032158 | A1 | 2/2010 | Dale et al. | |
| 2011/0011586 | A1* | 1/2011 | Dusterhoft | E21B 47/01 166/278 |
| 2011/0073308 | A1* | 3/2011 | Assal | E21B 43/08 166/278 |
| 2012/0305243 | A1* | 12/2012 | Hallundb.ae butted.k | E21B 43/12 166/255.1 |
| 2013/0014953 | A1* | 1/2013 | van Petegem | E21B 34/14 166/308.2 |

FOREIGN PATENT DOCUMENTS

WO 2013187878 A1 12/2013

OTHER PUBLICATIONS

International Search Report and Written Opinion issued in PCT/US2014/066028 on Feb. 24, 2015, 10 pages.

* cited by examiner

*Primary Examiner* — Taras P Bemko

(74) *Attorney, Agent, or Firm* — Jeffrey R. Peterson

(57) ABSTRACT

A technique facilitates formation of a gravel pack. Gravel slurry is delivered downhole through at least one solid walled tube disposed externally to a base pipe positioned in a wellbore. A structure is used to enable connection of base pipe joints while enabling flow of the gravel slurry past the base pipe joint connection and into a corresponding downstream tube or tubes. The gravel slurry is then discharged at a desired location to help form the gravel pack by depositing the gravel and separating the carrier fluid. The separated carrier fluid is returned back through at least one permeable dehydration tube.

15 Claims, 6 Drawing Sheets

SYSTEM AND METHODOLOGY FOR FORMING GRAVEL PACKS

CROSS-REFERENCE TO RELATED APPLICATION

The present document is based on and claims priority to U.S. Provisional Application Ser. No. 61/927,106, filed Jan. 14, 2014, incorporated herein by reference in its entirety.

BACKGROUND

Gravel packs are used in wells for removing particulates from inflowing hydrocarbon fluids. In a variety of applications gravel packing is performed in long horizontal wells by pumping gravel suspended in a carrier fluid down the annulus between the wellbore and a screen assembly. The carrier fluid is returned to the surface after depositing the gravel in the wellbore annulus. To return to the surface, the carrier fluid flows through the screen assembly, through base pipe perforations, and into a production tubing which routes the returning carrier fluid back to the surface. In some applications, inflow control devices have been combined with the screen assembly to provide control over the inflow of production fluids. However, the inflow control devices tend to provide insufficient open area for flow of the returning carrier fluid back into the production tubing.

SUMMARY

In general, a system and methodology are provided for facilitating formation of a gravel pack. Gravel slurry is delivered downhole through at least one solid walled tube disposed externally to a base pipe positioned in a wellbore. A structure is used to enable connection of base pipe joints and to facilitate flow of the gravel slurry past the base pipe joint connection and into a corresponding downstream tube or tubes. The gravel slurry is then discharged to facilitate formation of the gravel pack by depositing the gravel and separating the carrier fluid. The separated carrier fluid is returned back through at least one permeable dehydration tube.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate formation of gravel packs in wellbores. A gravel packing system is constructed so that gravel slurry is delivered downhole through a solid walled tube, e.g. a transport tube, which may comprise a plurality of solid walled tubes, e.g. transport tubes. The solid walled tubes are disposed externally to a base pipe positioned in a wellbore. A structure, e.g. an annular structure, commingles the flow of gravel slurry from the solid walled tubes disposed along a base pipe joint. The commingled flow of gravel slurry is delivered to corresponding solid walled tubes, e.g. transport tubes and packing tubes, of the next adjacent base pipe joint across a base pipe joint connection. The gravel slurry is then discharged into the wellbore annulus to facilitate formation of the gravel pack. The gravel pack is formed when the carrier fluid is returned to the surface via at least one permeable, dehydration tube. For example, the separated carrier fluid may be returned through a plurality of permeable dehydration tubes which direct the carrier fluid back into an interior of the base pipe via an opening in a perforated section of the base pipe.

In an embodiment, the gravel packing system utilizes a screen assembly which works in cooperation with an inflow control device. The gravel pack may be formed around the screen assembly and the tubes may be used as an alternate path approach to delivering gravel slurry to locations along the screen assembly while taking returns of carrier fluid through external permeable tubes cooperating with a perforated section or sections of the base pipe. In some applications, the returning carrier fluid may flow into the base pipe both through the perforated section(s) and through orifices of the inflow control device(s). As described below, the tubes positioned external to the base pipe can be spaced, e.g. equally spaced, around the outside of the base pipe and screen assembly to serve as slurry transport tubes, slurry packing tubes, and highly permeable dehydration tubes.

Figure 1:
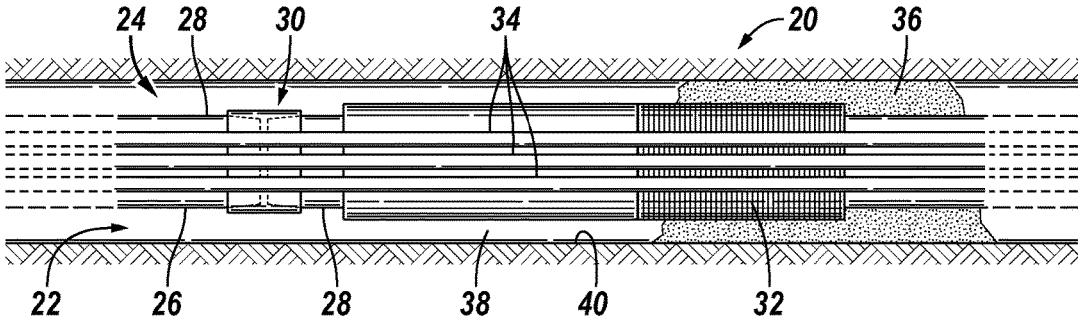
FIG. 1 is a schematic illustration of an example of a gravel packing system deployed in a wellbore, according to an embodiment of the disclosure.

Referring generally to FIG. 1, an example of a well system 20 deployed in a wellbore 22 is illustrated. In this example, well system 20 comprises a gravel packing system 24 having a base pipe 26 formed by joining a plurality of base pipe joints 28. For example, adjacent base pipe joints 28 may be coupled together at a base pipe joint connection 30, e.g. a threaded connection, threaded coupler, or other suitable connection. The gravel packing system 24 may comprise a variety of other components, such as a screen assembly 32 and a plurality of tubes 34 which may be located externally of the base pipe 26 and the screen assembly 32. As described in greater detail below, the tubes 34 may comprise solid walled tubes and permeable dehydration tubes. The solid walled tubes may be employed to deliver gravel slurry downhole for formation of a gravel pack 36 at a desired location in an annulus 38 between gravel packing system 24 and a surrounding wellbore wall 40 of wellbore 22. The permeable dehydration tubes may be used for separating the carrier fluid from the gravel, thus forming the gravel pack 36 and returning carrier fluid to a surface location or other collection location.

Figure 2:
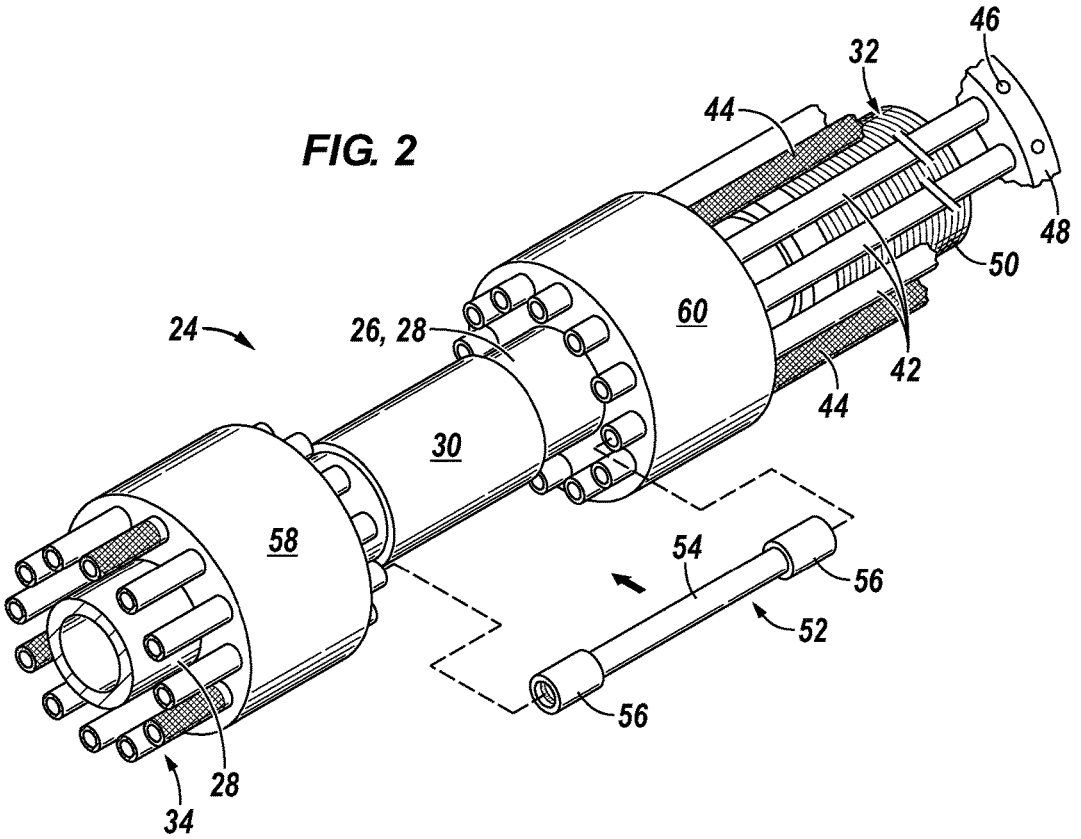
FIG. 2 is an orthogonal illustration of an example of the gravel packing system, according to an embodiment of the disclosure.

In FIG. 2, an example of gravel packing system 24 is illustrated. In this example, gravel packing system 24 comprises a plurality of base pipe joints 28 coupled together at base pipe joint connections 30 to form the internal base pipe 26. FIG. 2 illustrates a pair of adjacent base pipe joints 28, but the gravel packing system 24 may comprise additional base pipe joints 28 coupled together at additional base pipe joint connections 30. The plurality of external tubes 34 comprises both solid walled tubes 42 and permeable dehydration tubes 44. The solid walled tubes 42 deliver gravel slurry downhole and may comprise transport tubes and packing tubes. The transport tubes deliver the gravel slurry into packing tubes, and the packing tubes are disposed along specific base pipe joints 28 for discharging the gravel slurry at a desired gravel packing location. The packing tubes may discharge the gravel slurry through corresponding nozzles 46 which may be independent nozzles or nozzles formed in a nozzle ring 48 extending around the base pipe 26.

The solid walled tubes 42 and permeable dehydration tubes 44 are positioned externally of base pipe 26 and screen assembly 32, the screen assembly 32 being illustrated as having a filtering screen 50. In the embodiment illustrated, the external tubes 34, e.g. solid walled tubes 42 and permeable dehydration tubes 44, are disposed in sections along each base pipe joint 28 and coupled across the base pipe joint connection 30 via a plurality of corresponding jumper tube assemblies 52. Each jumper tube assembly 52 may comprise a jumper tube 54 having a connector 56 at each end of the jumper tube 54. The connectors 56 are designed with suitable seals, e.g. O-rings, which sealingly engage corresponding ends of the external tubes 34 to form a sealed flow path past the base pipe joint connection 30. This allows the base pipe joints 28 to be connected together, e.g. threaded together, at base pipe joint connection 30 while the external tubes 34 are disconnected. Once the base pipe joint connection 30 is made up, the jumper tube assemblies 52 may be connected to complete the flow paths along the external tubes 34. In some applications, the connectors 56 are linearly movable relative to the jumper tube 54 to facilitate engagement with tubes 34. It should be noted that in some applications the jumper tube assemblies 52 are not be used with the permeable dehydration tubes 44. In such embodiments, the permeable dehydration tubes 44 may reside within the length of individual screen joints carrying screen assemblies 32.

Referring again to the embodiment illustrated in FIG. 1, the external tubes 34 also work in cooperation with a slurry structure 58, e.g. an annular slurry structure, and a carrier fluid structure 60, e.g. an annular clean fluid structure. In the illustrated example, the structures 58, 60 are annular in that they extend over a portion or the entire annular space surrounding the base pipe 26. The slurry structure 58 commingles flow from a plurality of solid walled transport tubes 42 and the clean fluid structure 60 similarly commingles flow from a plurality of permeable dehydration tubes 44, as explained in greater detail below. Depending on the application, the number and arrangement of external tubes 34 and structures 58, 60 may vary. The tubes 34 may be equally spaced or unequally spaced around the base pipe 26. In several embodiments, the slurry structure 58 and carrier fluid structure 60 are positioned on opposing sides of a given base pipe joint connection 30 with respect to each other.

Figure 3:
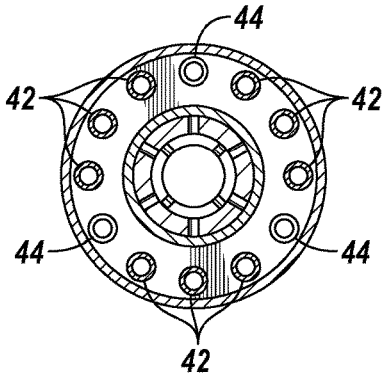
FIG. 3 is a cross-sectional view of an example of the gravel packing system illustrating a plurality of tubes for carrying gravel slurry and returning carrier fluid, according to an embodiment of the disclosure.

A pair of solid walled tubes 42 may be positioned between each pair of sequential permeable dehydration tubes 44 in a circumferential direction. As illustrated in FIG. 3, however, three solid walled tubes 42 may be positioned between each pair of sequential permeable dehydration tubes 44. In some applications, permeable dehydration tubes 44 may be positioned alongside each other without solid walled tubes 42 therebetween. Additionally, the solid walled tubes 42 located between corresponding permeable dehydration tubes 44 may comprise pairs of transport tubes with single packing tubes or other combinations of transport tubes and packing tubes. The actual number and arrangement of transport tubes, packing tubes, and permeable dehydration tubes may be substantially different from one gravel packing system to another. Similarly, the number of slurry structures 58 and clean carrier fluid structures 60 may vary depending on the length and structure of gravel packing system 24. For example, depending on the fluid dynamics of the system, the screen assembly or assemblies 32 may cooperate with zero, one, or a plurality of the returning carrier fluid structures 60. In some applications, a carrier fluid structure 60 may be used at every other screen assembly 32 or at specific, selected screen assemblies 32. However, some applications may incur conditions in which a plurality of carrier fluid structures 60 is used for each screen assembly 32 to ensure sufficient return rates for optimal gravel packing.

Figure 4:
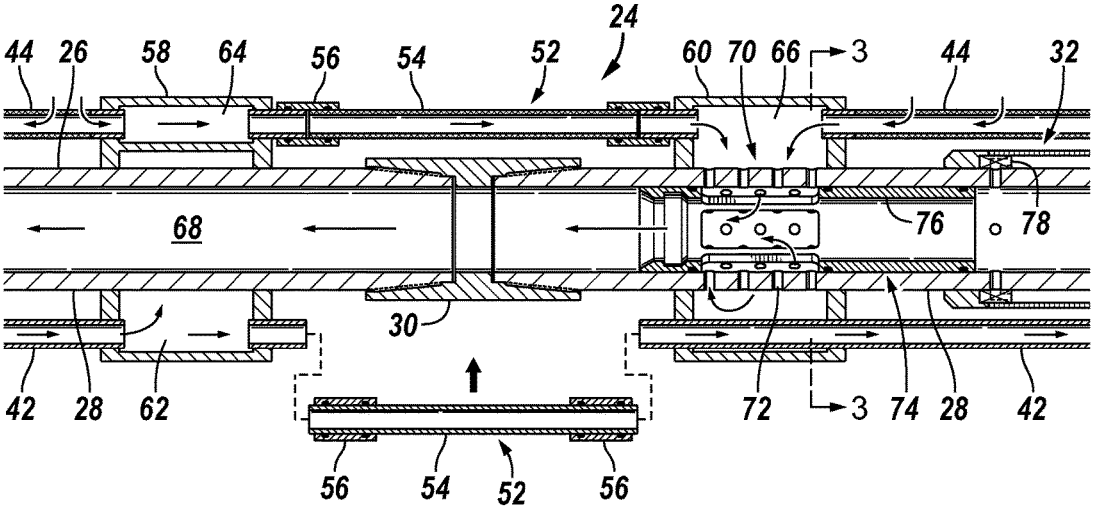
FIG. 4 is a cross-sectional view of the gravel packing system illustrated in FIG. 2, according to an embodiment of the disclosure.

Referring generally to FIG. 4, a cross-sectional view of the gravel packing system illustrated in FIG. 2 is provided to facilitate explanation of the operation of gravel packing system 24. In this example, each slurry structure 58 is an annular slurry structure which receives gravel slurry from a plurality of the solid walled transport tubes 42. The gravel slurry from the plurality of transport tubes 42 is commingled in a common region 62 within structure 58 before the flowing gravel slurry continues into downstream flow paths of, for example, at least one transport tube and at least one packing tube. After leaving the slurry structure 58, the gravel slurry moves through jumper tubes 54 past the corresponding base pipe joint connection 30 and into corresponding solid walled tubes 42, e.g. transport tubes or packing tubes, associated with the next sequential, downstream base pipe joint 28. In some applications, the gravel slurry may flow into and through a plurality of the slurry structures 58 associated with sequential base pipe joints 28. In the example illustrated, the returning carrier fluid, e.g. clean fluid, flows into permeable dehydration tubes 44 and at least some of the returning carrier fluid may be directed through the slurry structure 58 via an isolated flow passage 64.

In this example, each carrier fluid structure 60 is an annular structure having an internal common region 66 which receives returning, clean carrier fluid from the permeable dehydration tubes 44. The returning carrier fluid from the plurality of permeable dehydration tubes 44 is commingled in common region 66 and delivered into an interior 68 of base pipe 26 via a perforated section 70. The perforated section 70 has at least one opening 72 through which the returning carrier fluid passes from region 66 at an exterior of the base pipe 26 and into the interior 68 of base pipe 26. The flow of returning carrier fluid through perforated section 70 and into base pipe 26 may be controlled by a flow control mechanism 74. In the example illustrated in FIG. 4, the flow control mechanism 74 comprises a sliding sleeve 76 which may be selectively actuated to cover the perforated section 70 in part or completely.

In some applications, flow control mechanism 74 is employed to control flow through an inflow control device 78 which may be located beneath screen assembly 32 and filtering screen 50. The flow control mechanism 74 can be constructed to control flow through both or either perforated section 70 and inflow control device 78. In some applications, separate flow control mechanisms 74 may be used to independently control inflow of fluid through perforated section 70 and inflow control device 78. In this example, the inflow control device 78 may be used during production operations to enable the inflow of production fluids into interior 68 of base pipe 26. However, the inflow control device 78 also may be open during a gravel packing operation to receive a portion of the returning clean, carrier fluid.

Figure 5:
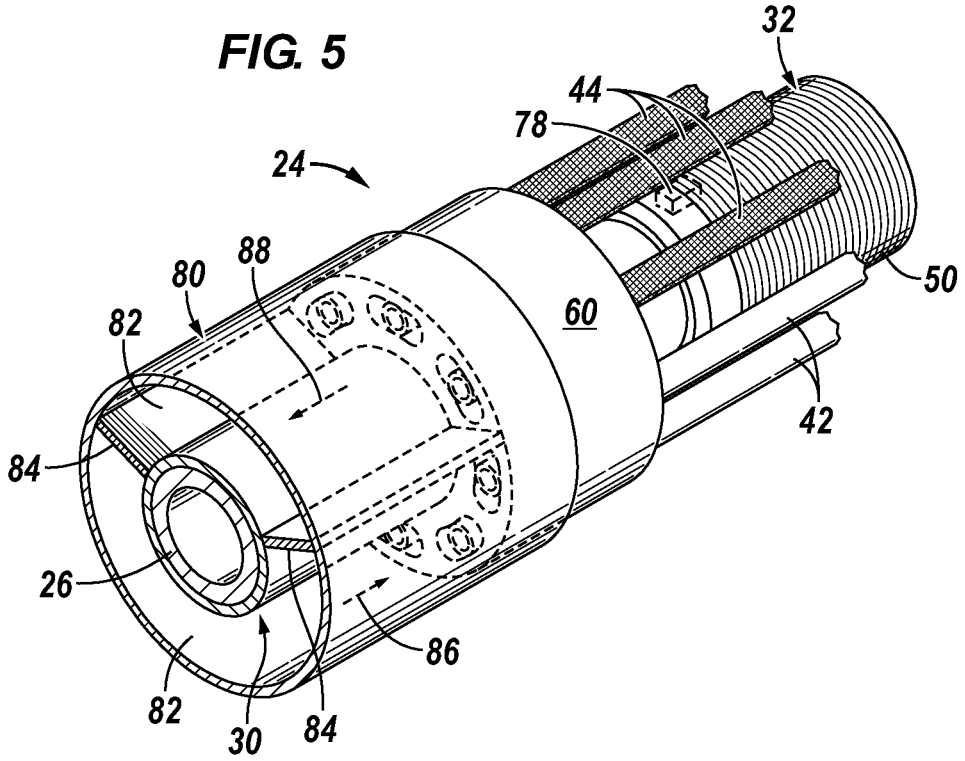
FIG. 5 is orthogonal view of another example of the gravel packing system, according to an embodiment of the disclosure.
Figure 6:
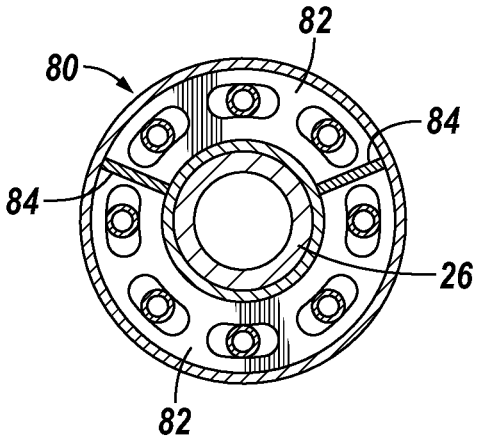
FIG. 6 is a cross-sectional view of an example of a bi-directional chambered sleeve of the gravel packing system illustrated in FIG. 5, according to an embodiment of the disclosure.
Figure 7:
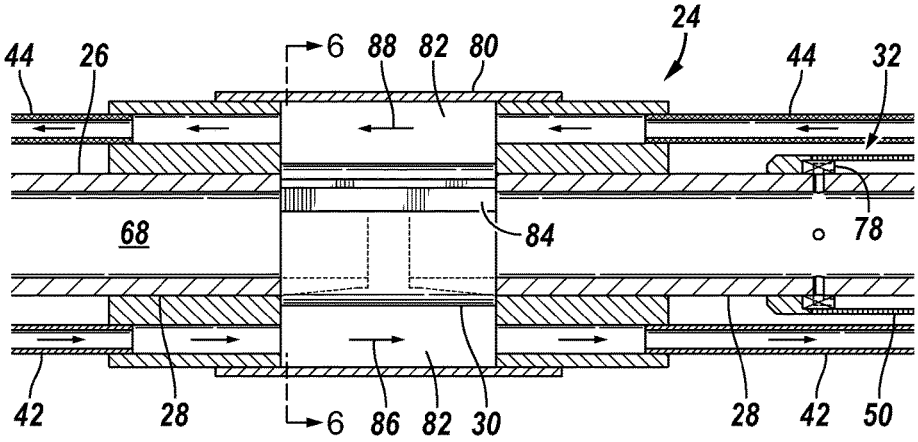
FIG. 7 is a cross-sectional view of the gravel packing system illustrated in FIG. 5, according to an embodiment of the disclosure.

Referring generally to FIGS. 5-7, another embodiment of gravel packing system 24 is illustrated. In this embodiment, the gravel packing system 24 is similar to the embodiments illustrated in FIGS. 2-4, but the jumper tube assemblies 52 have been replaced with a bi-directional chambered sleeve 80. The bi-directional chambered sleeve 80 comprises a plurality of chambers 82 separated by longitudinally oriented chamber dividers 84. The chambers 82 separate the flows of gravel slurry and returning carrier fluid, as represented by arrows 86 and 88, respectively, in FIGS. 5 and 7. In some applications, the bi-directional chambered sleeve 80 may be arranged coaxially with the inner base pipe 26. The chambers 82 provide flow paths for the gravel slurry and the returning clean fluid across base pipe joint connection 30 and between corresponding tubes 34 of adjacent base pipe joints 28.

Figure 8:
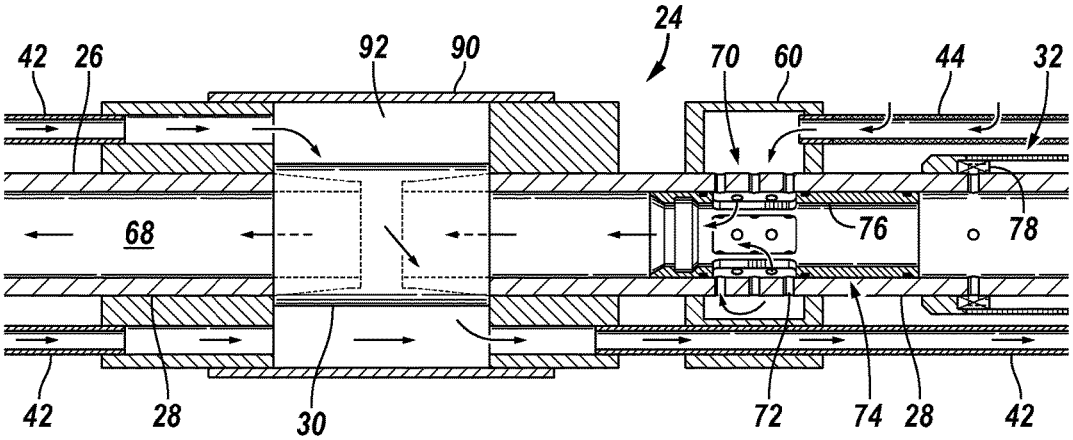
FIG. 8 is a cross-sectional view of another example of the gravel packing system, according to an embodiment of the disclosure.

In FIG. 8, another embodiment of the gravel packing system 24 is illustrated in which gravel slurry from a plurality of solid walled tubes 42 flow into a sleeve 90 extending across each base pipe joint connection 30. In this example, the sleeve 90 comprises an internal chamber 92 in which the gravel slurry from the plurality of solid walled tubes 42 is commingled and routed into adjacent solid walled tubes 42 of the next adjacent base pipe tubing joint 28. In this embodiment, the highly permeable tubes 44 route returning carrier fluid into perforated sections 70 at selected base pipe joints 28 without passing the corresponding base pipe joint connection 30.

Figure 9:
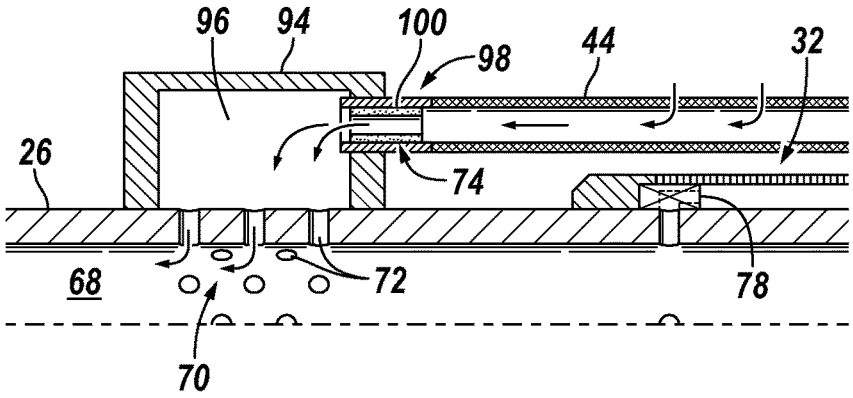
FIG. 9 is a cross-sectional view of an example of a flow control mechanism positioned along a returning carrier fluid flow path, according to an embodiment of the disclosure.
Figure 10:
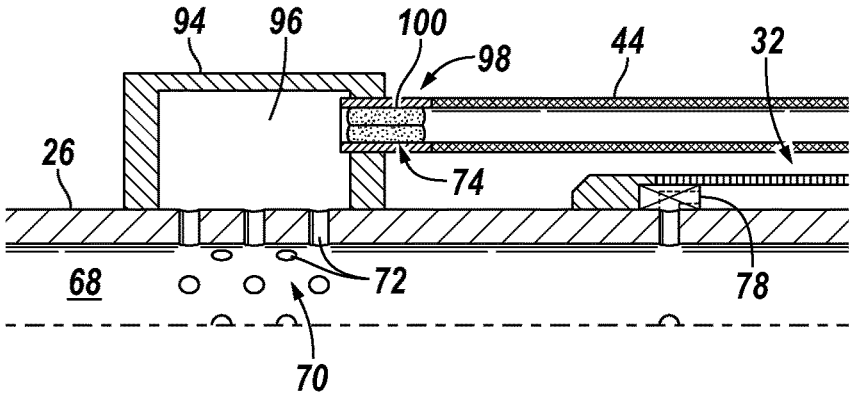
FIG. 10 is a cross-sectional view similar to that of FIG. 9 but showing the flow control mechanism in a different operational state, according to an embodiment of the disclosure.

Referring generally to FIGS. 9 and 10, an embodiment of gravel packing system 24 is illustrated with another example of flow control mechanism 74 positioned to control flow of fluid into base pipe 26. In this example, returning carrier fluid is delivered into a return housing 94 having a chamber 96 which directs the returning carrier fluid through perforated section 70 and into interior 68 of base pipe 26. In many applications, the return housing 94 and chamber 96 are simply embodiments of carrier fluid structure 60 and internal common region 66, respectively, as described above. At least one permeable dehydration tube 44 delivers the returning carrier fluid into the chamber 96 of return housing 94 via a tube outlet 98. However, flow through the perforated section 70 may be restricted upon completion of the gravel pack or at another suitable stage of the operation. In this example, the flow control mechanism 74 comprises a swellable material 100 placed along the flow path of the returning carrier fluid in, for example, tube outlet 98. When the swellable material 100 reacts with the reservoir fluids, e.g. production fluids, it swells and closes the tube outlet 98 (as illustrated in FIG. 10), thus creating a barrier to flow of fluid through the perforated section 70.

Figure 11:
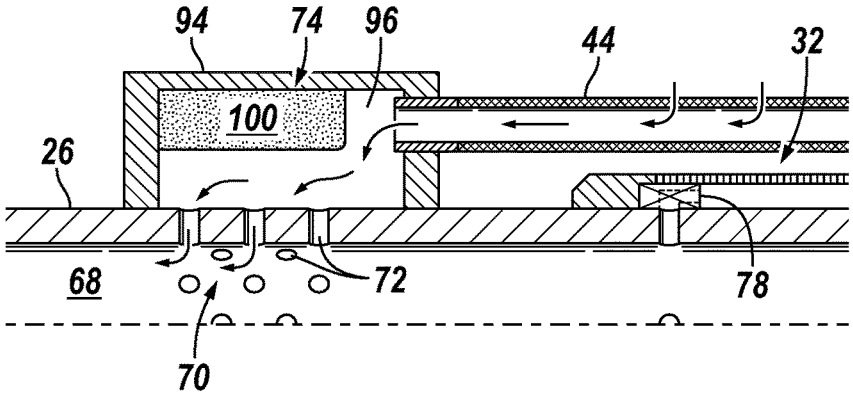
FIG. 11 is a cross-sectional view of another example of a flow control mechanism positioned along a returning carrier fluid flow path, according to an embodiment of the disclosure.
Figure 12:
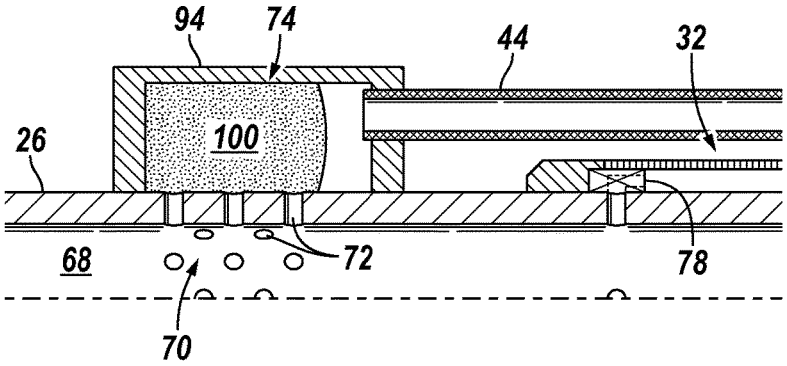
FIG. 12 is a cross-sectional view similar to that of FIG. 11 but showing the flow control mechanism in a different operational state, according to an embodiment of the disclosure.

In another embodiment, the flow control mechanism 74 again comprises swellable material 100. The swellable material 100 may be disposed within return housing 94, as illustrated in FIGS. 11 and 12. In this example, the return housing 94 again surrounds perforated section 70 and receives flow of returning carrier fluid from at least one permeable dehydration tube 44 during a gravel packing operation. However, flow through the perforated section 70 may be restricted upon completion of the gravel pack or at another suitable stage of the operation via the swellable material 100. When the swellable material 100 reacts with the reservoir fluids, e.g. production fluids, it swells into contact with the base pipe 26 within return housing 94 and closes the openings 72 of perforated section 70 (as illustrated in FIG. 12), thus creating a barrier to flow of fluid through the perforated section 70.

Figure 13:
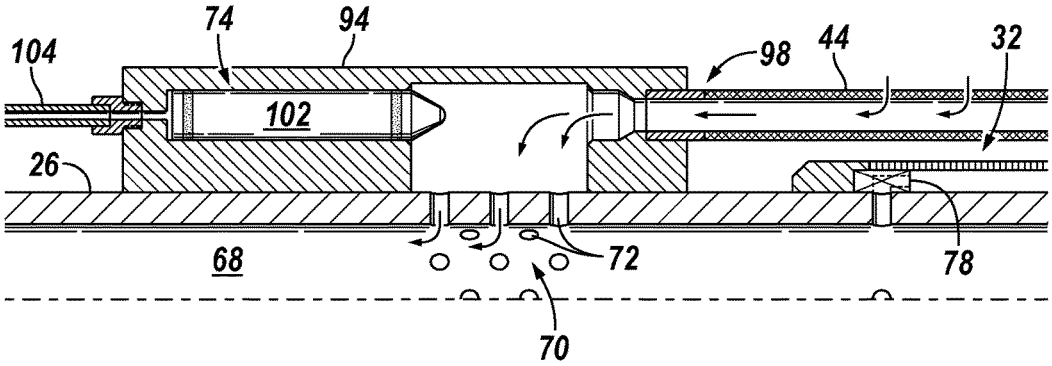
FIG. 13 is a cross-sectional view of another example of a flow control mechanism positioned along a returning carrier fluid flow path, according to an embodiment of the disclosure.
Figure 14:
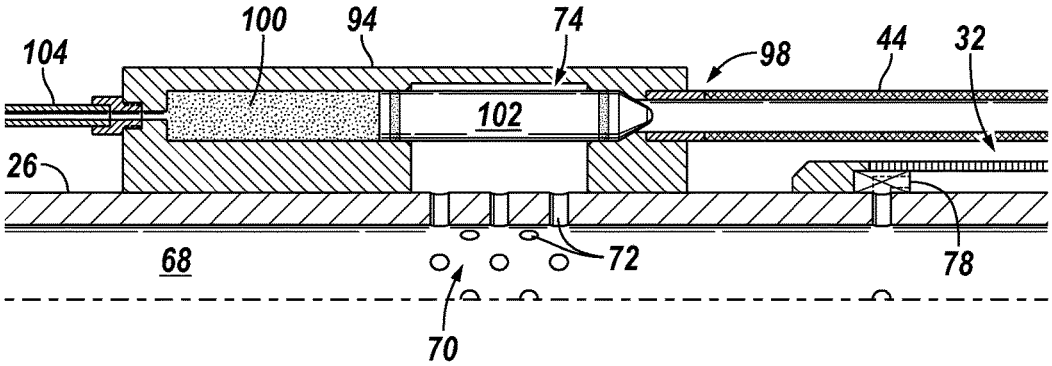
FIG. 14 is a cross-sectional view similar to that of FIG. 13 but showing the flow control mechanism in a different operational state, according to an embodiment of the disclosure.

The flow into base pipe 26 through perforated section 70 also may be controlled by other devices, such as a piston plug 102, as illustrated in FIGS. 13 and 14. In this embodiment, the flow control mechanism 74 comprises piston plug 102 which is slidably or otherwise movably mounted in return housing 94 for selective engagement with outlet 98. The piston plug 102 may be selectively moved by an actuator 104, such as an electric actuator, electro-mechanical actuator, hydraulic actuator, electric motor, swellable material actuator, or other suitable actuator. In some applications, swellable material 100 may be used to drive the piston plug 102, as illustrated in FIG. 14. In this latter example, once the swellable material 100 reacts to activating fluids, e.g. reservoir fluids, the swelling process pushes the piston plug 102 into the closed position, as illustrated in FIG. 14, thus closing off the tube outlet 98.

Actuators 104 may be used to enable selective closure of the perforated section 70 and this methodology may be used to effectively construct an adaptive flow or adaptive inflow control device screen assembly. Actuator 104 provides the ability to open and close the high flow rate flow path through the return housing 94 which transitions the screen assembly 32 between a more traditional screen in the open position and an inflow control device when piston plug 102 (or other suitable device) is moved into the closed position. In many of these applications, the actuator 104 may be hydraulically or electrically powered via suitable control lines routed to the surface.

In the examples illustrated herein, various combinations of tubes work in cooperation with various devices which facilitate flow of fluid across base pipe joint connections. The approach also facilitates make-up of the joint connections. However, many different numbers and arrangements of solid walled tubes and permeable dehydration tubes may be used in combination with the connection crossover devices to facilitate gravel packing operations. Additionally, a variety of screen assemblies, inflow control devices, and/or other components may be used in combination with the structures described herein to facilitate, for example, gravel packing system assembly, gravel packing operations, and production operations.

Many types of materials, components, and component configurations may be used in constructing the gravel packing system. For example, the screen assembly screens may be made from a variety of woven and nonwoven materials in various patterns and arrangements. Similarly, the permeable dehydration tubes may be made with various meshes, screens, porous materials, other suitable materials, and combinations of such materials. The gravel packing system also may comprise several different numbers of base pipe tubing joints arranged with individual or multiple screen assemblies and various numbers and arrangements of slurry structures and/or carrier structures.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a gravel packing system deployed in a wellbore and comprising:

a base pipe having a pair of base pipe joints coupled at a base pipe joint connection, the base pipe having a perforated section;

a screen disposed around the base pipe;

a plurality of solid walled tubes disposed along each base pipe joint to deliver a gravel slurry to a desired annulus region around the gravel packing system, wherein the plurality of solid walled tubes of each base pipe joint is coupled across each base pipe joint connection by a bidirectional, chambered sleeve;

a plurality of permeable dehydration tubes positioned to deliver a returning carrier fluid to the perforated section of the base pipe after delivery of the gravel slurry to the desired annulus region;

an annular slurry structure which commingles the gravel slurry received from solid walled tubes of the plurality of solid walled tubes before passing the base pipe joint connection; and an annular clean fluid structure which commingles the returning carrier fluid received from permeable dehydration tubes of the plurality of permeable dehydration tubes before delivering the returning carrier fluid into the base pipe through the perforated section.

2. The system as recited in claim 1, wherein the plurality of solid walled tubes of each base pipe joint is coupled across each base pipe joint connection by a plurality of jumper tubes.

3. The system as recited in claim 1, wherein the plurality of permeable dehydration tubes of each base pipe joint is coupled across each base pipe joint connection by a plurality of corresponding jumper tubes.

4. The system as recited in claim 1, wherein the gravel packing system further comprises an inflow control device positioned to control flow of a fluid into an interior of the base pipe after the fluid passes through the screen.

5. The system as recited in claim 1, wherein the gravel packing system comprises a flow control mechanism positioned to control flow of returning carrier fluid into the base pipe through at least one of the perforated section or a flow control device.

6. The system as recited in claim 5, wherein the flow control mechanism comprises a swellable material positioned in a tubing outlet.

7. The system as recited in claim 5, wherein the flow control mechanism comprises a piston movable to selectively block fluid flow.

8. The system as recited in claim 5, wherein the flow control mechanism comprises a sliding sleeve to selectively restrict flow through the perforated section.

9. The system as recited in claim 1, wherein the annular slurry structure and the annular clean fluid structure are on opposite sides of the base pipe joint connection with respect to each other.

10. A method to facilitate formation of a gravel pack, comprising:

delivering a gravel slurry through a plurality of solid walled tubes disposed externally to a base pipe positioned in a wellbore;

discharging the gravel slurry from the plurality of solid walled tubes into an annular structure disposed around the base pipe to commingle the gravel slurry;

flowing the gravel slurry from the annular structure into a plurality of downstream, solid walled tubes that extend across a base pipe joint connection, wherein flowing comprises flowing the gravel slurry past the base pipe joint connection via a bidirectional, chambered sleeve;

discharging the gravel slurry from at least one of the downstream, solid walled tubes into a surrounding annulus within the wellbore to build the gravel pack;

positioning a plurality of permeable dehydration tubes along the base pipe to receive a returning carrier fluid;

directing the returning carrier fluid from the plurality of permeable dehydration tubes into an annular clean fluid structure;

commingling the returning carrier fluid in the annular clean fluid structure; and communicating the commingled returning carrier fluid into the base pipe through an opening of the base pip.

11. The method as recited in claim 10, wherein flowing comprises flowing the gravel slurry past the base pipe joint connection via a plurality of jumper tubes.

12. The method as recited in claim 10, further comprising controlling flow of returning carrier fluid through the opening and into the base pipe via a sliding sleeve.

13. The method as recited in claim 10, further comprising controlling flow of returning carrier fluid through the opening and into the base pipe via a swellable material.

14. The method as recited in claim 10, further comprising controlling flow of returning carrier fluid through the opening and into the base pipe via a piston movable to selectively restrict flow.

15. A system for use in a well, comprising:

a gravel packing system deployed in a wellbore and comprising:

a base pipe having a pair of base pipe joints coupled at a base pipe joint connection, the base pipe having a perforated section;

a screen disposed around the base pipe;

a plurality of solid walled tubes disposed along each base pipe joint to deliver a gravel slurry to a desired annulus region around the gravel packing system;

a plurality of permeable dehydration tubes positioned to deliver a returning carrier fluid to the perforated section of the base pipe after delivery of the gravel slurry to the desired annulus region;

an annular slurry structure which commingles the gravel slurry received from solid walled tubes of the plurality of solid walled tubes before passing the base pipe joint connection; and an annular clean fluid structure which commingles the returning carrier fluid received from permeable dehydration tubes of the plurality of permeable dehydration tubes before delivering the returning carrier fluid into the base pipe through the perforated section; wherein at least one of the solid walled tubes extends through the annular clean fluid structure, and at least one of the permeable dehydration tubes extends through the annular slurry structure.

* * * * *